US011617044B2

(12) United States Patent
Carlile et al.

(10) Patent No.: US 11,617,044 B2
(45) Date of Patent: Mar. 28, 2023

(54) EAR-MOUNT ABLE LISTENING DEVICE WITH VOICE DIRECTION DISCOVERY FOR ROTATIONAL CORRECTION OF MICROPHONE ARRAY OUTPUTS

(71) Applicant: Iyo Inc., Redwood City, CA (US)

(72) Inventors: Simon Carlile, San Francisco, CA (US); Devansh Gupta, Edison, NJ (US); Jason Rugolo, Mountain View, CA (US)

(73) Assignee: Iyo Inc., Redwood City, CA (US)

( * ) Notice: Subject to any disclaimer, the term of this patent is extended or adjusted under 35 U.S.C. 154(b) by 2 days.

(21) Appl. No.: 17/192,652

(22) Filed: Mar. 4, 2021

(65) Prior Publication Data

US 2022/0286788 A1 Sep. 8, 2022

(51) Int. Cl.
*H04R 25/00* (2006.01)
*H04S 7/00* (2006.01)

(52) U.S. Cl.
CPC ..... *H04R 25/407* (2013.01); *H04R 25/405* (2013.01); *H04R 25/505* (2013.01); *H04R 25/604* (2013.01); *H04S 7/30* (2013.01); *H04R 2225/43* (2013.01); *H04S 2420/01* (2013.01)

(58) Field of Classification Search
CPC .... H04R 25/407; H04R 1/406; H04R 25/405; H04R 25/505; H04R 25/604; H04R 5/033; H04R 3/005; H04R 5/02; H04R 1/1008; H04R 29/00; H04R 29/005; H04R 2430/21; H04R 1/04; H04R 2225/43; H04S 7/30; H04S 2420/01
USPC ..... 381/370, 74, 379, 309, 58, 328, 91, 313
See application file for complete search history.

(56) References Cited

U.S. PATENT DOCUMENTS

| | | | |
|---|---|---|---|
| 6,068,589 | A | 5/2000 | Neukermans |
| 8,204,263 | B2 | 6/2012 | Pedersen et al. |
| 8,238,570 | B2 | 8/2012 | Johnson, Jr. et al. |
| 8,630,431 | B2 | 1/2014 | Gran |
| 9,510,112 | B2 | 11/2016 | Petersen et al. |
| 9,596,551 | B2 | 3/2017 | Pedersen et al. |
| 9,918,178 | B2 | 3/2018 | Norris et al. |
| 9,980,075 | B1 | 5/2018 | Benattar |

(Continued)

FOREIGN PATENT DOCUMENTS

| | | | |
|---|---|---|---|
| CN | 201294615 | Y * | 8/2009 |
| EP | 3 062 528 | A1 | 8/2016 |

(Continued)

OTHER PUBLICATIONS

International Search Report and Written Opinion, PCT App. No. PCT/US2022/017046, dated Jun. 13, 2022, 6 pages.

*Primary Examiner* — Norman Yu
(74) *Attorney, Agent, or Firm* — Nicholson Devos Webster & Elliott

(57) ABSTRACT

Techniques described herein include generating first audio signals representative of sounds emanating from an environment and captured with an array of microphones disposed within an ear-mountable listing device. A rotational position of the array of microphones is determined. A rotational correction is applied to the first audio signals to generate a second audio signal. The rotational correction is based at least in part upon the determined rotational position. A speaker of the ear-mountable listening device is driven with the second audio signal to output audio into an ear.

19 Claims, 12 Drawing Sheets

(56) References Cited

U.S. PATENT DOCUMENTS

| | | | | |
|---|---|---|---|---|
| 10,142,745 | B2 | 11/2018 | Petersen et al. | |
| 2002/0001389 | A1 | 1/2002 | Amiri et al. | |
| 2006/0067548 | A1 | 3/2006 | Slaney et al. | |
| 2011/0137209 | A1 | 6/2011 | Lahiji et al. | |
| 2012/0328119 | A1 | 12/2012 | Heise | |
| 2014/0119553 | A1 | 5/2014 | Usher et al. | |
| 2015/0003622 | A1 | 1/2015 | Lee et al. | |
| 2015/0230036 | A1* | 8/2015 | Pedersen | H04R 1/1041 381/330 |
| 2017/0332186 | A1 | 11/2017 | Riggs et al. | |
| 2018/0197527 | A1 | 7/2018 | Guiu et al. | |
| 2019/0090075 | A1* | 3/2019 | Lee | G10K 11/17873 |
| 2020/0177986 | A1 | 6/2020 | Wen | |
| 2020/0213711 | A1 | 7/2020 | Rugolo et al. | |

FOREIGN PATENT DOCUMENTS

| | | | |
|---|---|---|---|
| GB | 2 364 121 | A | 1/2002 |
| KR | 10-2017-0034076 | A | 3/2017 |
| WO | 2012/018641 | A2 | 2/2012 |

* cited by examiner

EAR-MOUNT ABLE LISTENING DEVICE WITH VOICE DIRECTION DISCOVERY FOR ROTATIONAL CORRECTION OF MICROPHONE ARRAY OUTPUTS

TECHNICAL FIELD

This disclosure relates generally to ear mountable listening devices.

BACKGROUND INFORMATION

Ear mounted listening devices include headphones, which are a pair of loudspeakers worn on or around a user's ears. Circumaural headphones use a band on the top of the user's head to hold the speakers in place over or in the user's ears. Another type of ear mounted listening device is known as earbuds or earpieces and include individual monolithic units that plug into the user's ear canal.

Both headphones and ear buds are becoming more common with increased use of personal electronic devices. For example, people use headphones to connect to their phones to play music, listen to podcasts, place/receive phone calls, or otherwise. However, headphone devices are currently not designed for all-day wearing since their presence blocks outside noises from entering the ear canal without accommodations to hear the external world when the user so desires. Thus, the user is required to remove the devices to hear conversations, safely cross streets, etc.

Hearing aids for people who experience hearing loss are another example of an ear mountable listening device. These devices are commonly used to amplify environmental sounds. While these devices are typically worn all day, they often fail to accurately reproduce environmental cues, thus making it difficult for wearers to localize reproduced sounds. As such, hearing aids also have certain drawbacks when worn all day in a variety of environments. Furthermore, conventional hearing aid designs are fixed devices intended to amplify whatever sounds emanate from directly in front of the user. However, an auditory scene surrounding the user may be more complex and the user's listening needs may not be as simple as merely amplifying sounds emanating directly in front of the user.

With any of the above ear mountable listening devices, monolithic implementations are common. These monolithic designs are not easily custom tailored to the end user, and if damaged, require the entire device to be replaced at greater expense. Accordingly, a dynamic, multi-use, cost effective, ear mountable listening device capable of providing all day comfort in a variety of auditory scenes is desirable.

BRIEF DESCRIPTION OF THE DRAWINGS

Non-limiting and non-exhaustive embodiments of the invention are described with reference to the following figures, wherein like reference numerals refer to like parts throughout the various views unless otherwise specified. Not all instances of an element are necessarily labeled so as not to clutter the drawings where appropriate. The drawings are not necessarily to scale, emphasis instead being placed upon illustrating the principles being described.

DETAILED DESCRIPTION

Embodiments of a system, apparatus, and method of operation for an ear-mountable listening device having a microphone array and electronics capable of correcting an audio output to compensate for changes in the rotational position of the microphone array are described herein. In the following description numerous specific details are set forth to provide a thorough understanding of the embodiments. One skilled in the relevant art will recognize, however, that the techniques described herein can be practiced without one or more of the specific details, or with other methods, components, materials, etc. In other instances, well-known structures, materials, or operations are not shown or described in detail to avoid obscuring certain aspects.

Reference throughout this specification to "one embodiment" or "an embodiment" means that a particular feature, structure, or characteristic described in connection with the embodiment is included in at least one embodiment of the present invention. Thus, the appearances of the phrases "in one embodiment" or "in an embodiment" in various places throughout this specification are not necessarily all referring to the same embodiment. Furthermore, the particular features, structures, or characteristics may be combined in any suitable manner in one or more embodiments.

Figure 1A:
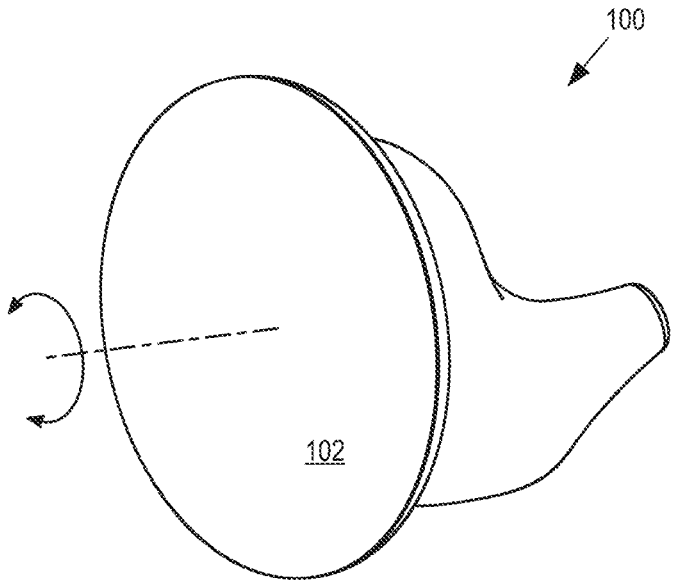
FIG. 1A is a front perspective illustration of an ear-mountable listening device, in accordance with an embodiment of the disclosure.
Figure 1B:
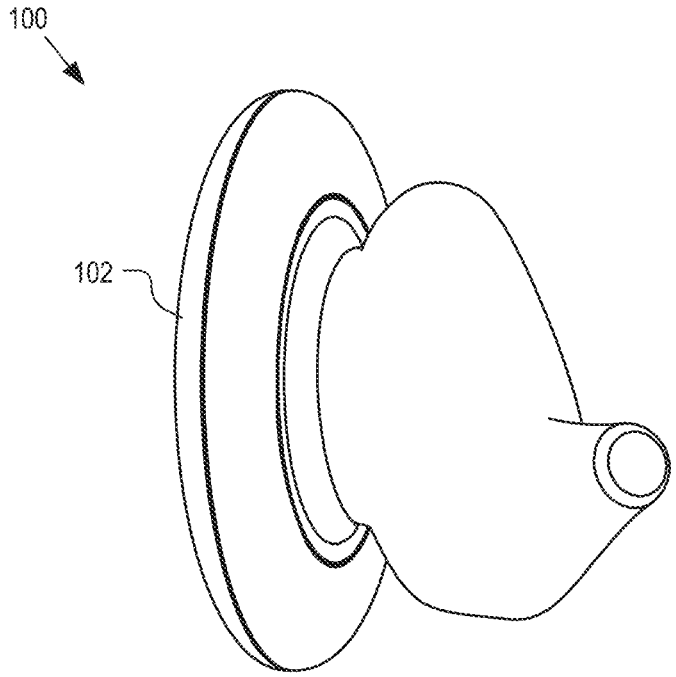
FIG. 1B is a rear perspective illustration of the ear-mountable listening device, in accordance with an embodiment of the disclosure.
Figure 1C:
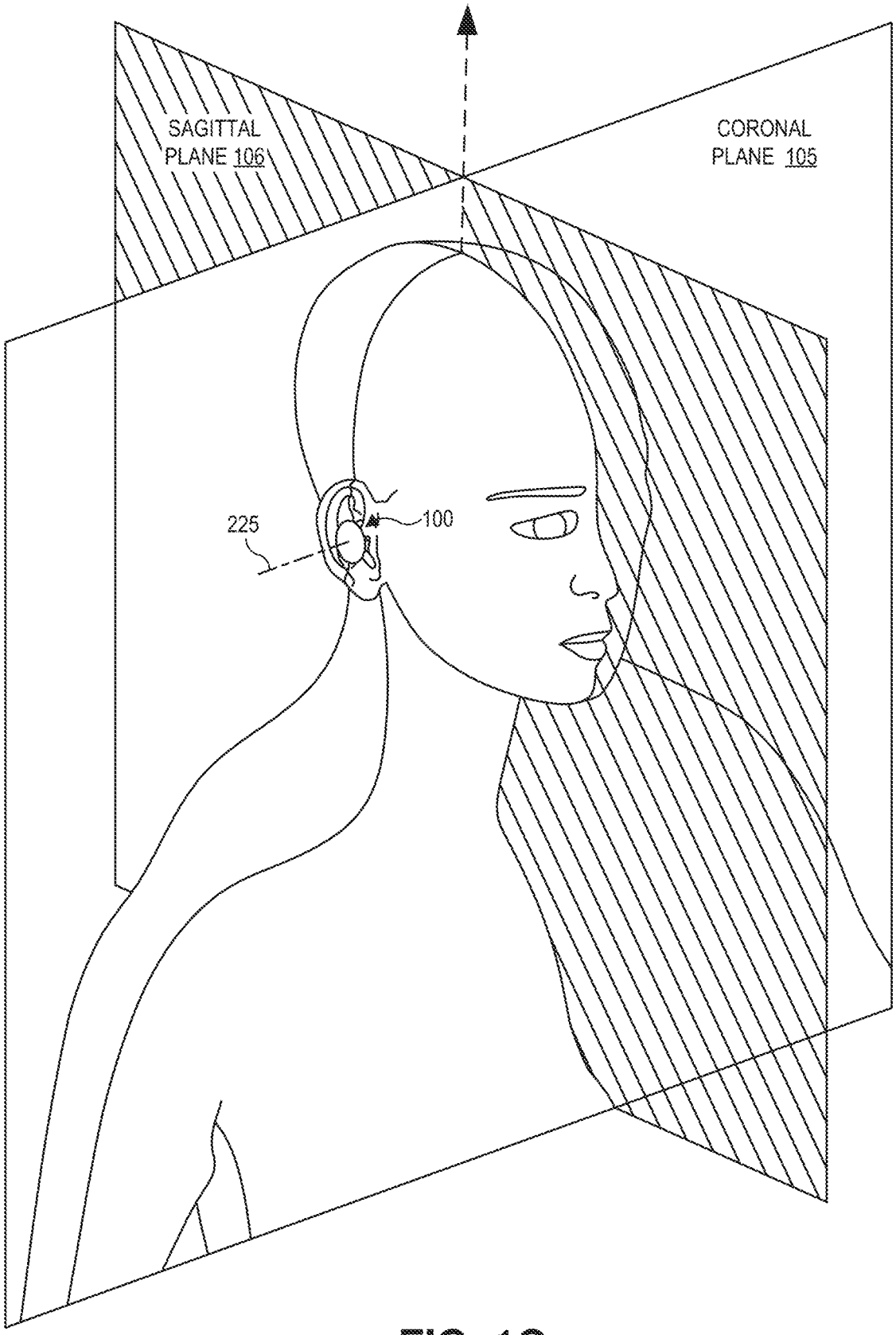
FIG. 1C illustrates the ear-mountable listening device when worn plugged into an ear canal, in accordance with an embodiment of the disclosure.

FIGS. 1A-C illustrate an ear-mountable listening device 100, in accordance with an embodiment of the disclosure. In various embodiments, ear-mountable listening device 100 (also referred to herein as an "ear device") is capable of facilitating a variety auditory functions including wirelessly connecting to (and/or switching between) a number of audio sources (e.g., Bluetooth connections to personal computing devices, etc.) to provide in-ear audio to the user, controlling the volume of the real world (e.g., modulated noise cancellation and transparency), providing speech hearing enhancements, localizing environmental sounds for spatially selective cancellation and/or amplification, and even rendering auditory virtual objects (e.g., auditory assistant or other data sources as speech or auditory icons). Ear-mountable listening device 100 is amenable to all day wearing. When the user desires to block out external environmental sounds, the mechanical design and form factor along with active noise cancellation can provide substantial external noise dampening (e.g., 40 to 50 dB though other levels of attenuation may be implemented). When the user desires a natural auditory interaction with their environment, ear-mountable listening device 100 can provide near (or perfect) perceptual transparency by reassertion of the user's natural Head Related Transfer Function (HRTF), thus maintaining spaciousness of sound and the ability to localize sound origination in the environment based upon the audio output from the ear device. When the user desires auditory aid or augmentation, ear-mountable listening device 100 may be capable of acoustical beamforming to dampen or nullify deleterious sounds while enhancing others based on their different location in space about the user. The auditory enhancement may select sound(s) based on other differentiating characteristics such as pitch or voice quality and also be capable of amplitude and/or spectral enhancements to facilitate specific user functions (e.g., enhance a specific voice frequency originating from a specific direction while dampening other background noises). In some embodiments, machine learning principles may even be applied to sound segregation and signal reinforcement.

In various embodiments, the ear-mountable listening device 100 includes a rotatable component 102 in which the microphone array for capturing sounds emanating from the user's environment is disposed. Rotatable component 102 may serve as a rotatable user interface for controlling one or more user selectable functions (e.g., volume control, etc.) thus changing the rotational position of the microphone array with respect to the user's ear. Additionally, each time the user inserts or mounts ear-mountable listening device 100 to their ear, they may do so with some level of rotational variability. These rotational variances of the internal microphone array affect the ability to preserve spaciousness and spatial awareness of the user's environment, to reassert the user's natural HRTF, or to leverage acoustical beamforming techniques in an intelligible and useful manner for the end-user. Accordingly, techniques described herein apply a rotational correct that compensates for these rotational variances of the microphone array.

Figure 1D:
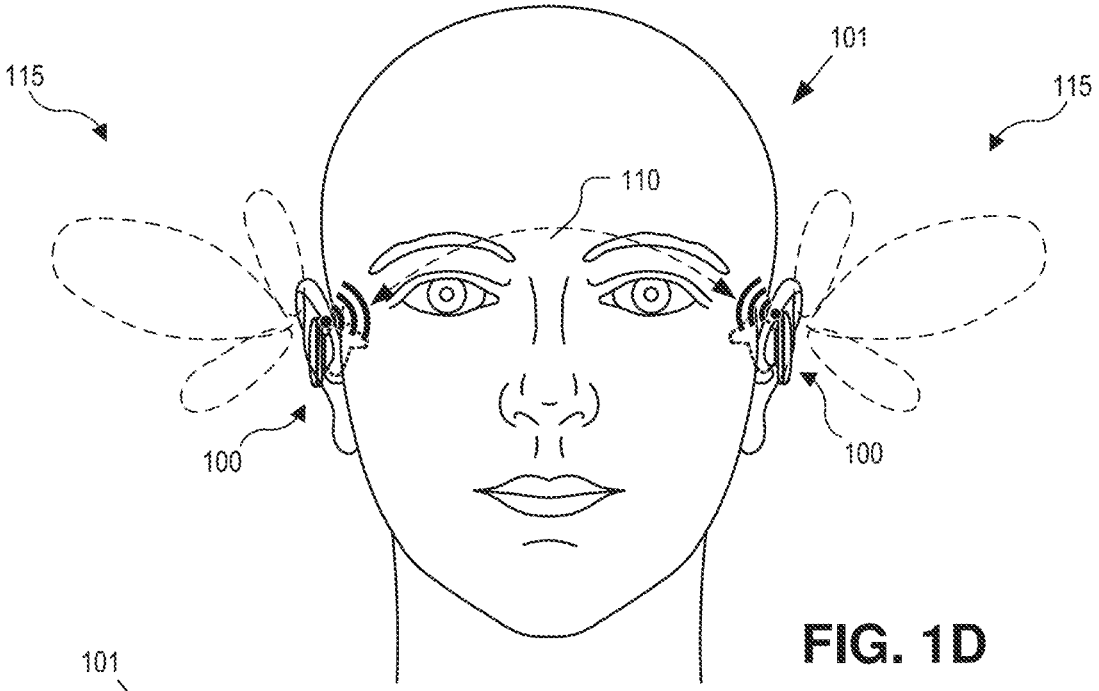
FIG. 1D illustrates a binaural listening system where the microphone arrays of each ear-mountable listening device are linked via a wireless communication channel, in accordance with an embodiment of the disclosure.
Figure 1E:
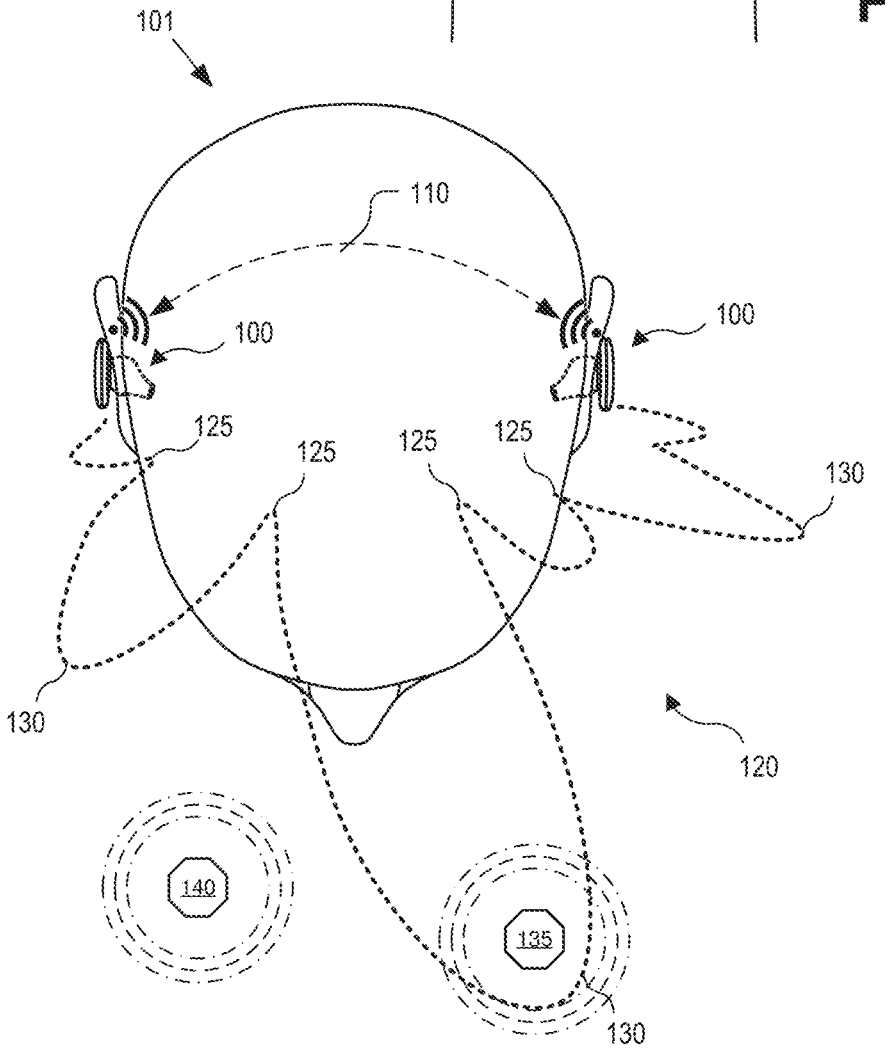
FIG. 1E illustrates acoustical beamforming to selectively steer nulls or lobes of the linked microphone arrays, in accordance with an embodiment of the disclosure.

FIGS. 1D and 1E illustrate how a pair of ear-mountable listening devices 100 can be linked via a wireless communication channel 110 to form a binaural listening system 101. The microphone array (adaptive phased array) of each ear device 100 can be operated separately with its own distinct acoustical gain pattern 115 or linked to form a linked adaptive phased array generating a linked acoustical gain pattern 120. Binaural listening system 101 operating as a linked adaptive phased array provides greater physical separation between the microphones than the microphones within each ear-mountable listening device 100 alone. This greater physical separation facilitates improved acoustical beamforming down to lower frequencies than is capable with a single ear device 100. In one embodiment, the inter-ear separation enables beamforming at the fundamental frequency (f0) of a human voice. For example, an adult male human has a fundamental frequency ranging between 100-120 Hz, while f0 of an adult female human voice is typically one octave higher, and children have a f0 around 300 Hz. Embodiments described herein provide sufficient physical separation between the microphone arrays of binaural listening system 101 to localize sounds in an environment having an f0 as low as that of an adult male human voice, as well as, adult female and children voices, when the adaptive phased arrays are linked across paired ear devices 100.

FIG. 1E further illustrates how the microphone arrays of each ear device 100, either individually or when linked, can operate as adaptive phased arrays capable of selective spatial filtering of sounds in real-time or on-demand in response to a user command. The spatial filtering is achieved via acoustical beamforming that steers either a null 125 or a lobe 130 of acoustical gain pattern 120. If a lobe 130 is steered in the direction of a unique source 135 of sound, then unique source 135 is amplified or otherwise raised relative to the background noise level. On the other hand, if a null 125 is steered towards a unique source 140 of sound, then unique source 140 is cancelled or otherwise attenuated relative to the background noise level.

The steering of nulls 125 and/or lobes 135 is achieved by adaptive adjustments to the weights (e.g., gain or amplitude) or phase delays applied to the audio signals output from each microphone in the microphone arrays. The phased array is adaptive because these weights or phase delays are not fixed, but rather dynamically adjusted, either automatically due to implicit user inputs or on-demand in response to explicit user inputs. Acoustical gain pattern 120 itself may be adjusted to have a variable number and shape of nulls 125 and lobes 130 via appropriate adjustment to the weights and phase delays. This enables binaural listening system 101 to cancel and/or amplify a variable number of unique sources 135, 140 in a variable number of different orientations relative to the user. For example, the binaural listening system 101 may be adapted to attenuate unique source 140 directly in front of the user while amplifying or passing a unique source positioned behind or lateral to the user.

Figure 1F:
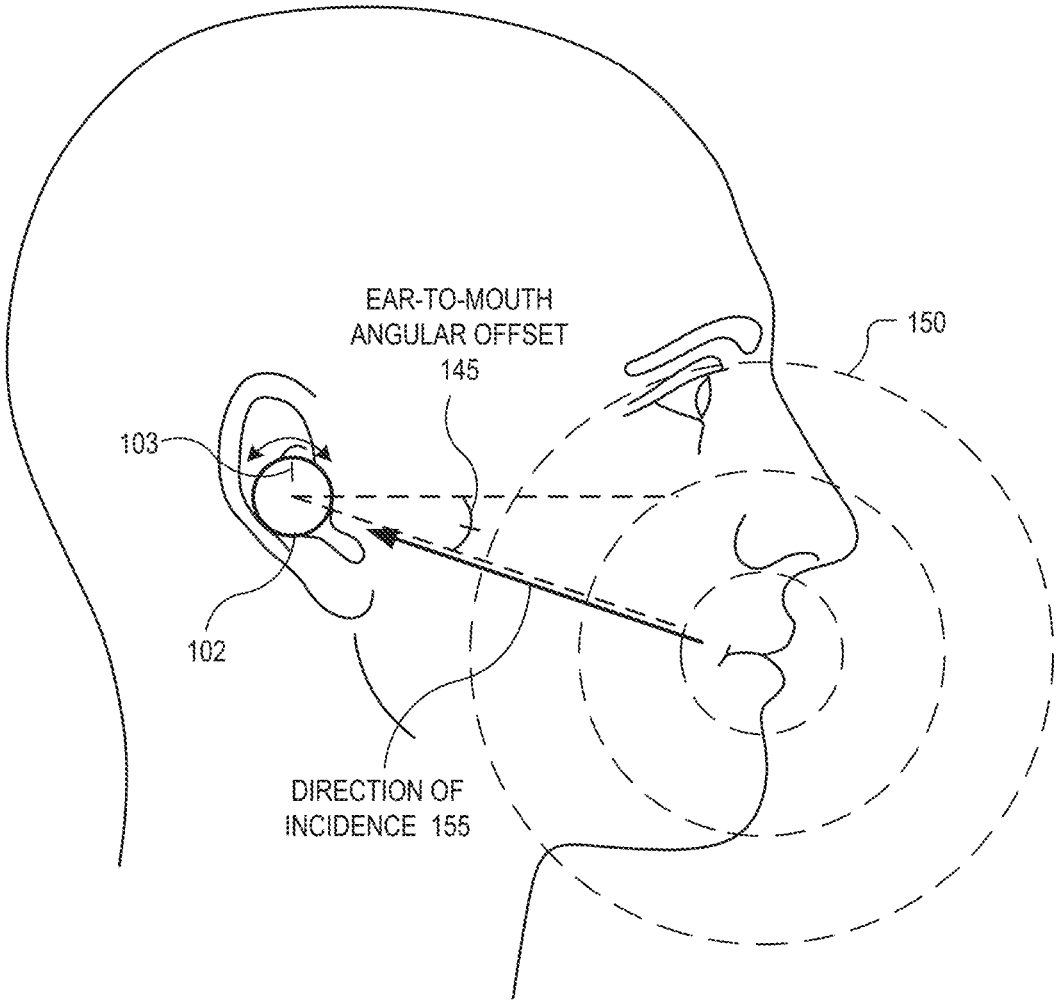
FIG. 1F is a profile illustration depicting an ear-to-mouth angular offset, in accordance with an embodiment of the disclosure.

FIG. 1F is a profile illustration depicting an ear-to-mouth angular offset 145, in accordance with an embodiment of the disclosure. As illustrated, the user's own voice 150 may be used to determine the rotational position of component 102, which includes the microphone array. The rotational position is a rotational position measured relative to the user's ear. Since the user's voice primarily emanates from their mouth, voice 150 may be used as a proxy for determining the rotational position of component 102 relative to their ear. However, to do so ear-to-mouth angular offset 145 should be applied. In some embodiments, average or typical values for ear-to-mouth angular offset 145 for different demographics (e.g., adult, child, male, female, etc.) may be used. In yet other embodiments, ear-to-mouth angular offset 145 may be a customized value calibrated on a per user basis. A voice direction discovery routine, as described below, may be used to measure the direction of incidence 155 of the user's voice 150 emanating from his/her mouth. Once the direction of incidence 155 is determined, ear-to-mouth angular offset 145 may be applied to determine the correct rotational correction for the given user.

In one embodiment, the rotational position of component 102 (including the microphone array) is tracked in real-time as it varies. Variability in the rotational position may be due to variability in rotational placement when the user inserts, or otherwise mounts, ear device 100 to his/her ear, or due to intentional rotations of component 102 when used as a user interface for selecting/adjusting a user function (e.g., volume control). Once the rotational position of component 102 is determined, an appropriate rotational correction (e.g., rotational transformation) may be applied by the electronics to the audio signals captured by the microphone array, thus enabling preservation of the user's ability to localize sounds in their physical environment despite rotational changes in component 102 (and the internal microphone array) relative to the ear.

Figure 2:
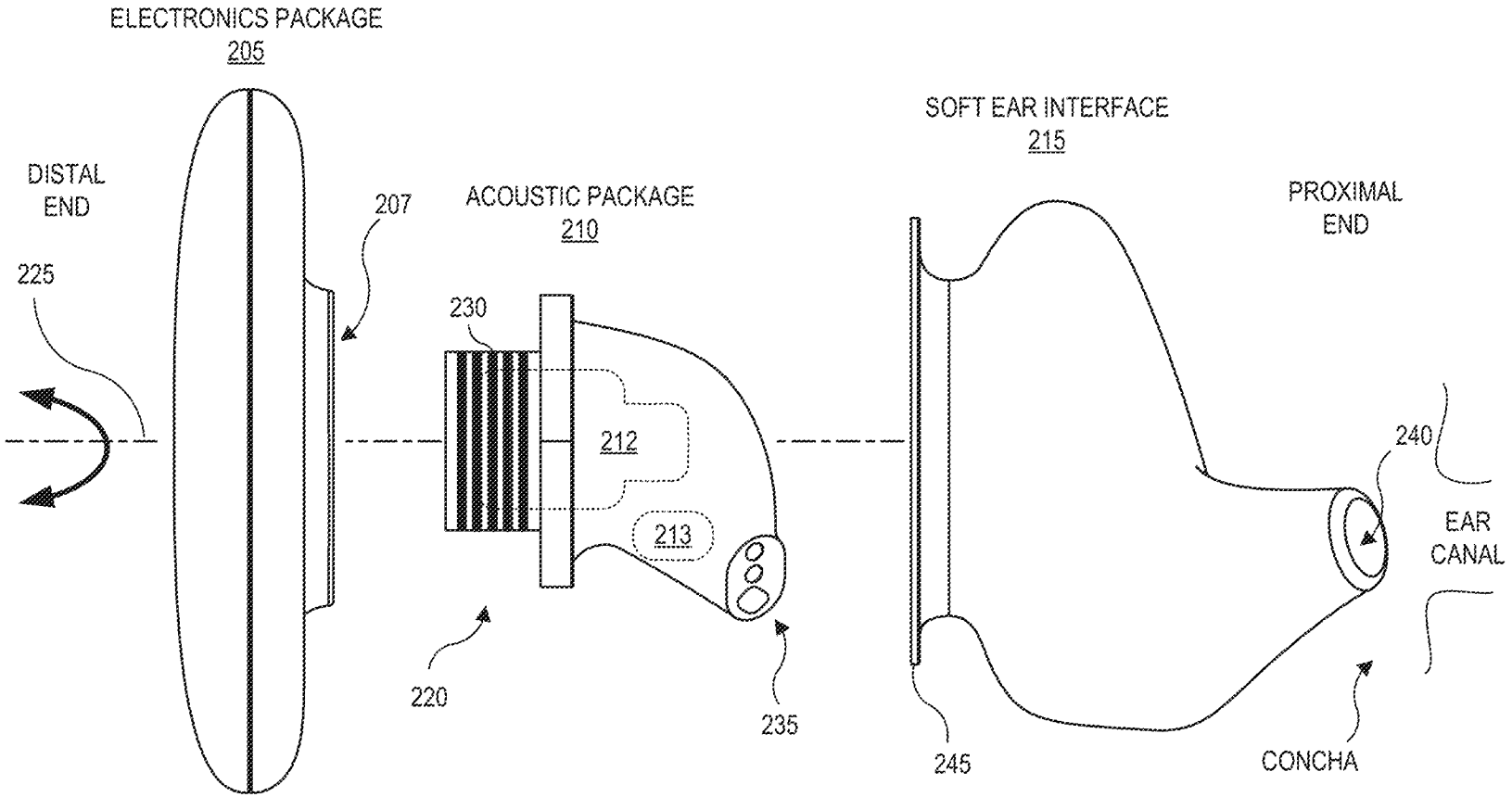
FIG. 2 is an exploded view illustration of the ear-mountable listening device, in accordance with an embodiment of the disclosure.

Referring to FIG. 2, ear-mountable listening device 100 has a modular design including an electronics package 205, an acoustic package 210, and a soft ear interface 215. The three components are separable by the end-user allowing for any one of the components to be individually replaced should it be lost or damaged. The illustrated embodiment of electronics package 205 has a puck-like shape and includes an array of microphones for capturing external environmental sounds along with electronics disposed on a main circuit board for data processing, signal manipulation, communications, user interfaces, and sensing. In some embodiments, the main circuit board has an annular disk shape with a central hole to provide a compact, thin, or close-into-the-ear form factor.

The illustrated embodiment of acoustic package 210 includes one or more speakers 212, and in some embodiments, an internal microphone 213 oriented and positioned to focus on user noises emanating from the ear canal, along with electromechanical components of a rotary user interface. A distal end of acoustic package 210 may include a cylindrical post 220 that slides into and couples with a cylindrical port 207 on the proximal side of electronics package 205. In embodiments where the main circuit board within electronics package 205 is an annular disk, cylindrical port 207 aligns with the central hole (e.g., see FIG. 6B). The annular shape of the main circuit board and cylindrical port 207 facilitate a compact stacking of speaker(s) 212 with the microphone array within electronics package 205 directly in front of the opening to the ear canal enabling a more direct orientation of speaker 212 to the axis of the auditory canal. Internal microphone 213 may be disposed within acoustic package 210 and electrically coupled to the electronics within electronics package 205 for audio processing (illustrated), or disposed within electronics package 205 with a sound pipe plumbed through cylindrical post 220 and extending to one of the ports 235 (not illustrated). Internal microphone 213 may be shielded and oriented to focus on user sounds originating via the ear canal. Additionally, internal microphone 213 may also be part of an audio feedback control loop for driving cancellation of the ear occlusion effect.

Post 220 may be held mechanically and/or magnetically in place while allowing electronics package 205 to be rotated about central axial axis 225 relative to acoustic package 210 and soft ear interface 215. Electronics package 205 represents one possible implementation of rotatory component 102 illustrated in FIG. 1A. This rotation of electronics package 205 relative to acoustic package 210 implements a rotary user interface. The mechanical/magnetic connection facilitates rotational detents (e.g., 8, 16, 32) that provide a force feedback as the user rotates electronic package 205 with their fingers. Electrical trace rings 230 disposed circumferentially around post 220 provide electrical contacts for power and data signals communicated between electronics package 205 and acoustic package 210. In other embodiments, post 220 may be eliminated in favor of using flat circular disks to interface between electronics package 205 and acoustic package 210.

Soft ear interface 215 is fabricated of a flexible material (e.g., silicon, flexible polymers, etc.) and has a shape to insert into a concha and ear canal of the user to mechanically hold ear-mountable listening device 100 in place (e.g., via friction or elastic force fit). Soft ear interface 215 may be a custom molded piece (or fabricated in a limited number of sizes) to accommodate different concha and ear canal sizes/shapes. Soft ear interface 215 provides a comfort fit while mechanically sealing the ear to dampen or attenuate direct propagation of external sounds into the ear canal. Soft ear interface 215 includes an internal cavity shaped to receive a proximal end of acoustic package 210 and securely holds acoustic package 210 therein, aligning ports 235 with in-ear aperture 240. A flexible flange 245 seals soft ear interface 215 to the backside of electronics package 205 encasing acoustic package 210 and keeping moisture away from acoustic package 210. Though not illustrated, in some embodiments, acoustic package 210 may include a barbed ridge that friction fits or "clicks" into a mating indent feature within soft ear interface 215.

FIG. 1C illustrates how ear-mountable listening device 100 is held by, mounted to, or otherwise disposed in the user's ear. As illustrated, soft ear interface 215 is shaped to hold ear-mountable listening device 100 with central axial axis 225 substantially falling within (e.g., within 20 degrees) a coronal plane 105. As is discussed in greater detail below, an array of microphones extends around central axial axis 225 in a ring pattern that substantially falls within a sagittal plane 106 of the user. When ear-mountable listening device 100 is worn, electronics package 205 is held close to the pinna of the ear and aligned along, close to, or within the pinna plane. Holding electronics package 205 close into the pinna not only provides a desirable industrial design (relative to further out protrusions), but may also have less impact on the user's HRTF, or more readily lend itself to a definable/characterizable impact on the user's HRTF, for which offsetting calibration may be achieved. As mentioned, the central hole in the main circuit board along with cylindrical port 207 facilitate this close in mounting of electronics package 205 despite mounting speakers 212 directly in front of the ear canal in between electronics package 205 and the ear canal along central axial axis 225.

Figure 3:
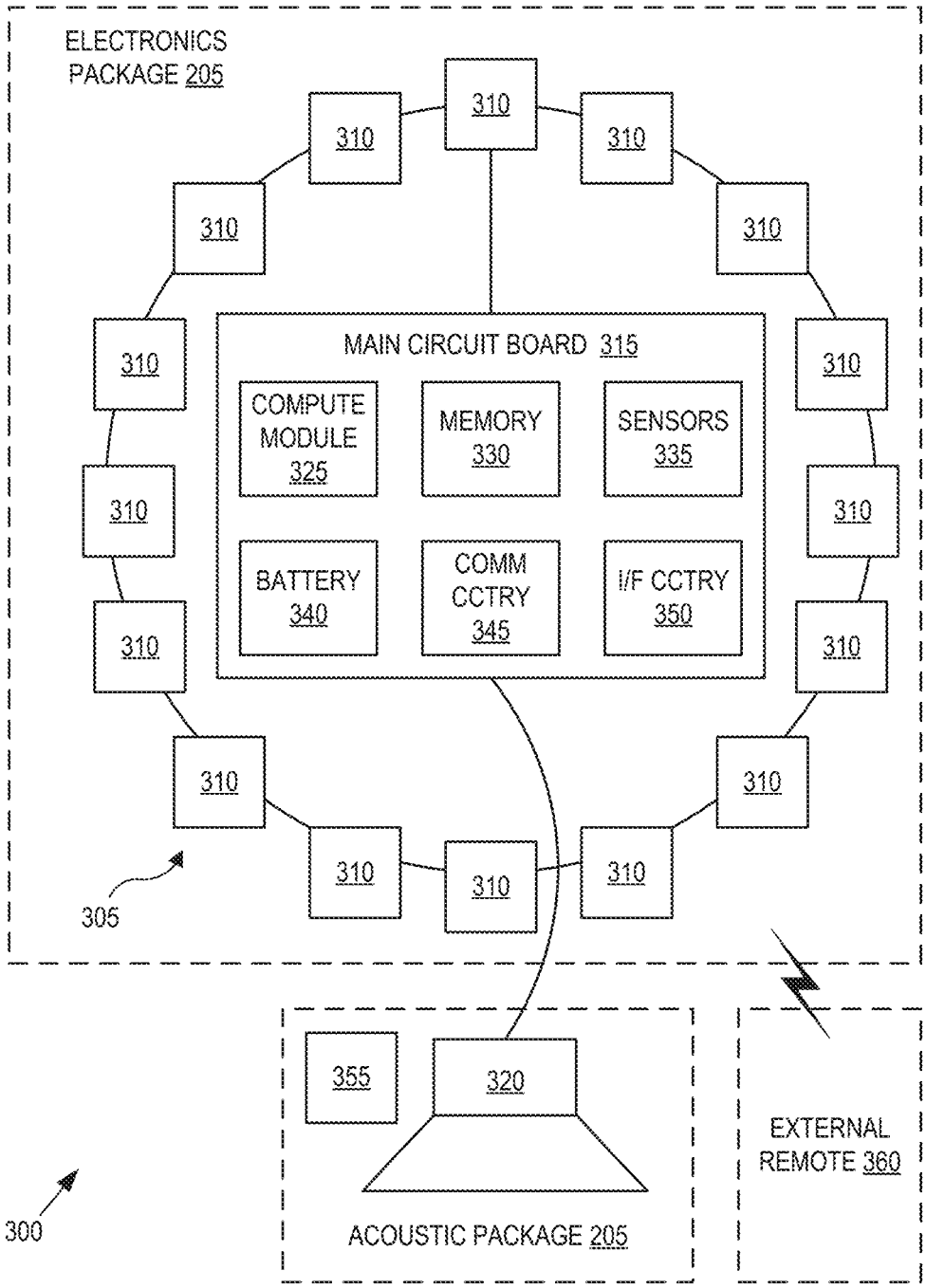
FIG. 3 is a block diagram illustrating select functional components of the ear-mountable listening device, in accordance with an embodiment of the disclosure.

FIG. 3 is a block diagram illustrating select functional components 300 of ear-mountable listening device 100, in accordance with an embodiment of the disclosure. The illustrated embodiment of components 300 includes an array 305 of microphones 310 (aka microphone array 305) and a main circuit board 315 disposed within electronics package 205 while speaker(s) 320 are disposed within acoustic package 205. Main circuit board 315 includes various electronics disposed thereon including a compute module 325, memory 330, sensors 335, battery 340, communication circuitry 345, and interface circuitry 350. The illustrated embodiment also includes an internal microphone 355 disposed within acoustic package 205. An external remote 360 (e.g., handheld device, smart ring, etc.) is wirelessly coupled to ear-mountable listening device 100 (or binaural listening system 101) via communication circuitry 345. Although not illustrated, acoustic package 205 may also include some electronics for digital signal processing (DSP), such as a printed circuit board (PCB) containing a signal decoder and DSP processor for digital-to-analog (DAC) conversion and EQ processing, a bi-amped crossover, and various auto-noise cancellation and occlusion processing logic.

In one embodiment, microphones 310 are arranged in a ring pattern (e.g., circular array, elliptical array, etc.) around a perimeter of main circuit board 315. Main circuit board 315 itself may have a flat disk shape, and in some embodiments, is an annular disk with a central hole. There are a number of advantages to mounting multiple microphones 310 about a flat disk on the side of the user's head for an ear-mountable listening device. However, one limitation of such an arrangement is that the flat disk restricts what can be done with the space occupied by the disk. This becomes a significant limitation if it is necessary or desirable to orientate a loudspeaker, such as speaker 320 (or speakers 212), on axis with the auditory canal as this may push the flat disk (and thus electronics package 205) quite proud of the ears. In the case of a binaural listening system, protrusion of electronics package 205 significantly out past the pinna plane may even distort the natural time of arrival of the sounds to each ear and further distort spatial perception and the user's HRTF potentially beyond a calibratable correction. Fashioning the disk as an annulus (or donut) enables protrusion of the driver of speaker 320 (or speakers 212) through main circuit board 315 and thus a more direct orientation/alignment of speaker 320 with the entrance of the auditory canal.

Microphones 310 may each be disposed on their own individual microphone substrates. The microphone port of each microphone 310 may be spaced in substantially equal angular increments about central axial axis 225. In FIG. 3, sixteen microphones 310 are equally spaced; however, in other embodiments, more or less microphones may be distributed (evenly or unevenly) in the ring pattern, or other geometry, about the central axial axis 225.

Compute module 325 may include a programmable microcontroller that executes software/firmware logic stored in memory 330, hardware logic (e.g., application specific integrated circuit, field programmable gate array, etc.), or a combination of both. Although FIG. 3 illustrates compute module 325 as a single centralized resource, it should be appreciated that compute module 325 may represent multiple compute resources disposed across multiple hardware elements on main circuit board 315 and which interoperate to collectively orchestrate the operation of the other functional components. For example, compute module 325 may execute logic to turn ear-mountable listening device 100 on/off, monitor a charge status of battery 340 (e.g., lithium ion battery, etc.), pair and unpair wireless connections, switch between multiple audio sources, execute play, pause, skip, and volume adjustment commands (received from interface circuitry 350, commence multi-way communication sessions (e.g., initiate a phone call via a wirelessly coupled phone), control volume of the real-world environment passed to speaker 320 (e.g., modulate noise cancellation and perceptual transparency), enable/disable speech enhancement modes, enable/disable smart volume modes (e.g., adjusting max volume threshold and noise floor), or otherwise. In one embodiment, compute module 325 includes trained neural networks.

Sensors 335 may include a variety of sensors such as an inertial measurement unit (IMU) including one or more of a three axis accelerometer, a magnetometer (e.g., compass), a gyroscope, or any combination thereof. Communication interface 345 may include one or more wireless transceivers including near-field magnetic induction (NFMI) communication circuitry and antenna, ultra-wideband (UWB) transceivers, a WiFi transceiver, a radio frequency identification (RFID) backscatter tag, a Bluetooth antenna, or otherwise. Interface circuitry 350 may include a capacitive touch sensor disposed across the distal surface of electronics package 205 to support touch commands and gestures on the outer portion of the puck-like surface, as well as a rotary user interface (e.g., rotary encoder) to support rotary commands by rotating the puck-like surface of electronics package 205. A mechanical push button interface operated by pushing on electronics package 205 may also be implemented.

Figure 4A:
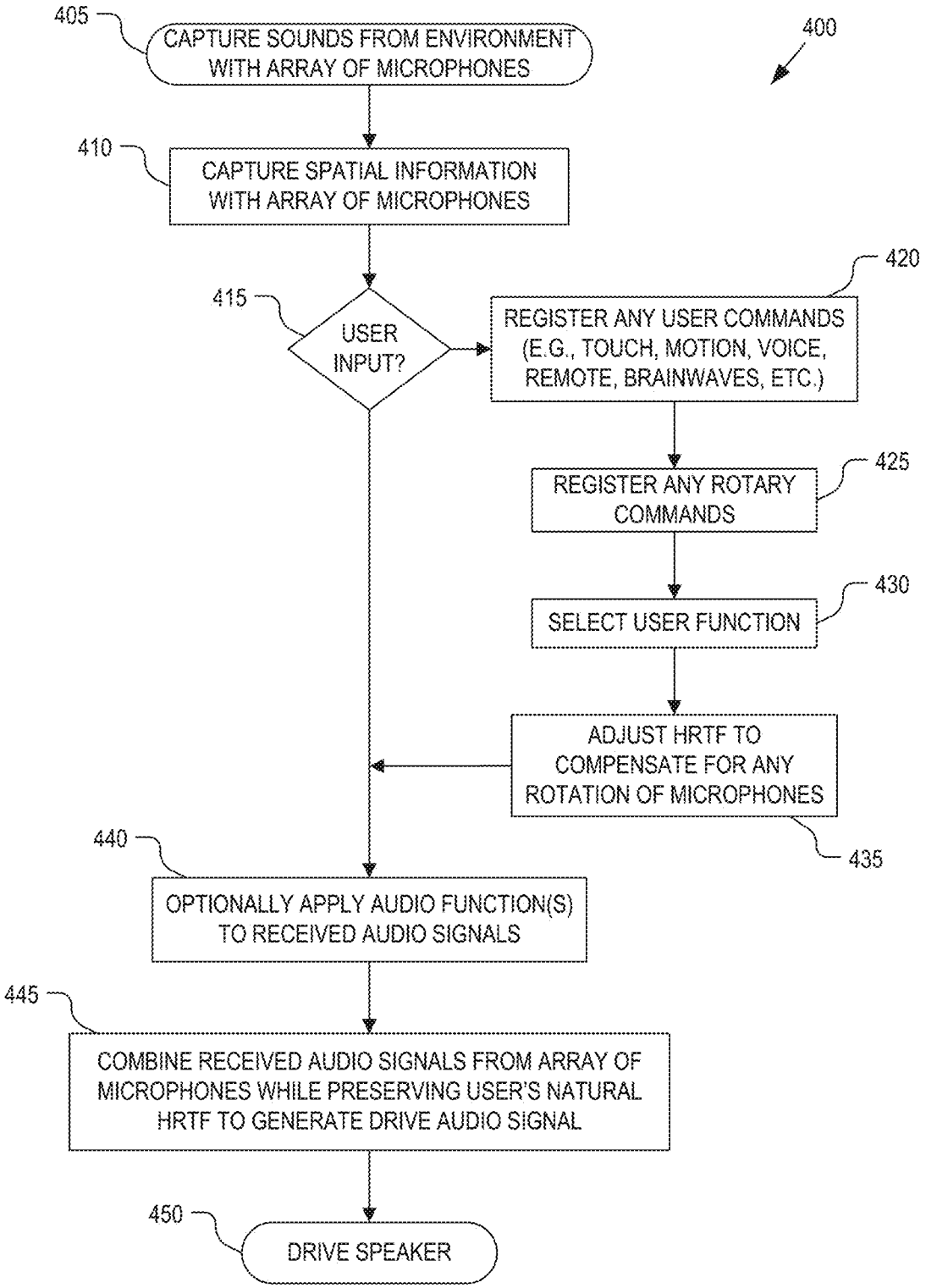
FIG. 4A is a flow chart illustrating operation of the ear-mountable listening device, in accordance with an embodiment of the disclosure.

FIG. 4A is a flow chart illustrating a process 400 for operation of ear-mountable listening device 100, in accordance with an embodiment of the disclosure. The order in which some or all of the process blocks appear in process 400 should not be deemed limiting. Rather, one of ordinary skill in the art having the benefit of the present disclosure will understand that some of the process blocks may be executed in a variety of orders not illustrated, or even in parallel.

In a process block 405, sounds from the external environment incident upon array 305 are captured with microphones 310. Due to the plurality of microphones 310 along with their physical separation, the spaciousness or spatial information of the sounds is also captured (process block 410). By organizing microphones 310 into a ring pattern (e.g., circular array) with equal angular increments about central axial axis 225, the spatial separation of microphones 310 is maximized for a given area thereby improving the spatial information that can be extracted by compute module 325 from array 305. Of course, other geometries may be implemented and/or optimized to capture various perceptually relevant acoustic information by sampling some regions more densely than others. In the case of binaural listening system 101 operating with linked microphone arrays, additional spatial information can be extracted from the pair of ear devices 100 related to interaural differences. For example, interaural time differences of sounds incidents on each of the user's ears can be measured to extract spatial information. Level (or volume) difference cues can be analyzed between the user's ears. Spectral shaping differences between the user's ears can also be analyzed. This interaural spatial information is in addition to the intra-aural time and spectral differences that can be measured across a single microphone array 305. All of this spatial/spectral information can be captured by arrays 305 of the binaural pair and extracted from the incident sounds emanating from the user's environment.

Spatial information includes the diversity of amplitudes and phase delays across the acoustical frequency spectrum of the sounds captured by each microphone 310 along with the respective positions of each microphone. In some embodiments, the number of microphones 310 along with their physical separation (both within a single ear-mountable listening device and across a binaural pair of ear-mountable listening devices worn together) can capture spatial information with sufficient spatial diversity to localize the origination of the sounds within the user's environment. Compute module 325 can use this spatial information to recreate an audio signal for driving speaker(s) 320 that preserves the spaciousness of the original sounds (in the form of phase delays and amplitudes applied across the audible spectral range). In one embodiment, compute module 325 is a neural network trained to leverage the spatial information and reassert, or otherwise preserve, the user's natural HRTF so that the user's brain does not need to relearn a new HRTF when wearing ear-mountable listening device 100. In yet another embodiment, compute module 325 includes one or more DSP modules. By monitoring the rotational position of microphone array 305 in real-time and applying a rotational correction, the HRTF is preserved despite rotational variability. While the human mind is capable of relearning new HRTFs within limits, such training can take over a week of uninterrupted learning. Since a user of ear-mountable listening device 100 (or binaural listening system 101) would be expected to wear the device some days and not others, or for only part of a day, preserving/reasserting the user's natural HRTF may help avoid disorientating the user and reduce the barrier to adoption of a new technology.

In a decision block 415, if any user inputs are sensed, process 400 continues to process blocks 420 and 425 where any user commands are registered. In process block 420, user commands may be touch commands (e.g., via a capacitive touch sensor or mechanical button disposed in electronics package 205), motion commands (e.g., head motions or nodes sensed via a motion sensor in electronics package 205), voice commands (e.g., natural language or vocal noises sensed via internal microphone 355 or array 305), a remote command issued via external remote 360, or brainwaves sensed via brainwave sensors/electrodes disposed in or on ear devices 100 (process block 420). Touch commands may even be received as touch gestures on the distal surface of electronics package 205.

Figure 4B:
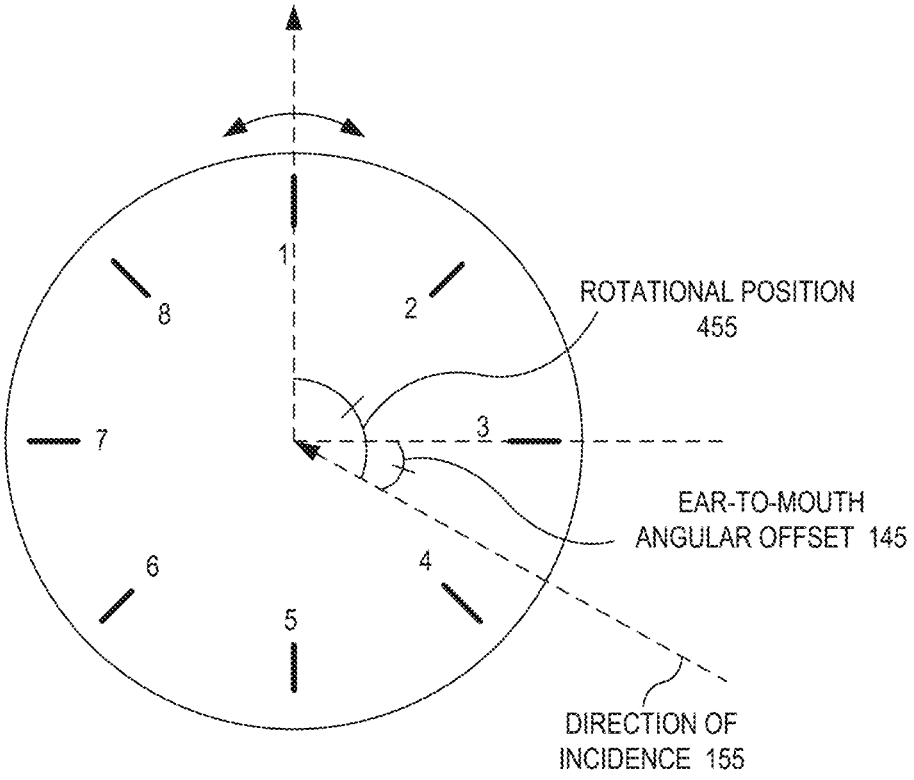
FIGS. 4B and 4C illustrate physical rotations of a microphone array, in accordance with an embodiment of the disclosure.
Figure 4C:
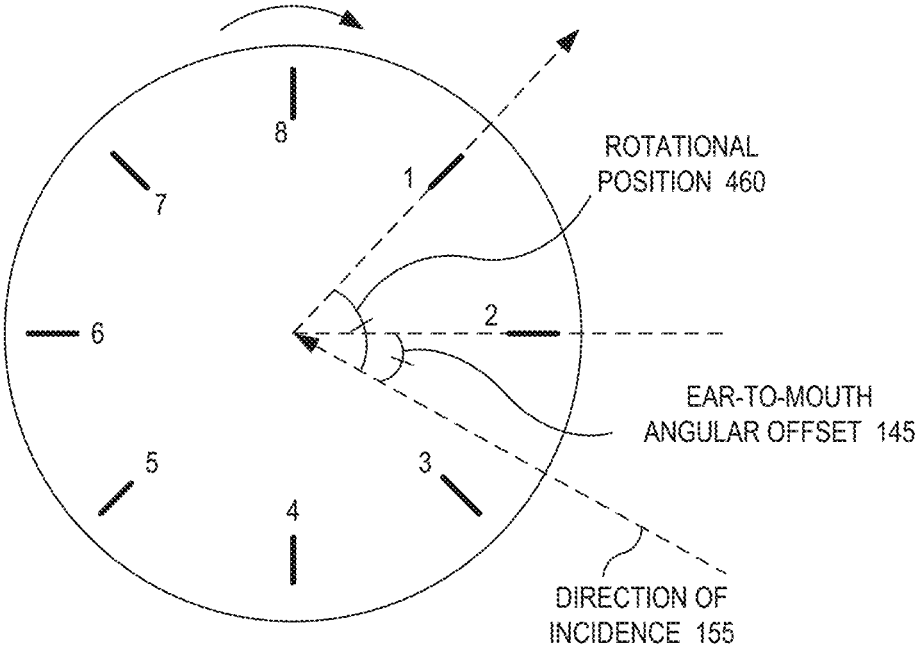

User commands may also include rotary commands received via rotating electronics package 205 (process block 425). The rotary commands may be determined using the IMU to sense each rotational detent via sensing changes in the gravitational or magnetic vectors. Alternatively (or additionally), microphone array 305 may be used to sense the rotational orientation of electronics package 205 using a voice direction discovery and thus implement the rotary encoder. Referring to FIG. 4B, the user's own voice originates from the user's mouth, which has a fixed location relative to the user's ears (i.e., ear-to-mouth angular offset) 145. As such, the array of microphones 310 may be used to perform acoustical beamforming to localize the direction of incidence 155 of the user's voice. The direction of incidence 155 is then used to determine the rotational position 455 of microphone array 305. The ear-to-mouth angular offset 145 is then applied to translate the incidence sounds to the natural reference frame of the user's ear. If microphone array 305 is rotated (e.g., see FIG. 4C), direction of incidence 155 will correlate to a revised rotational position 460 relative to a default position or reference microphone 310. The revised rotational position 460 is again offset by ear-to-mouth angular offset 145.

Since the user may not be talking when operating the rotary interface, the acoustical beamforming and localization may be a periodic calibration while the IMU or other rotary encoders are used for instantaneous registration of rotary motion. Alternatively, if the user is determined to be talking or making other vocal noises, but is vigorously moving (e.g., jogging, playing sports, etc.) such that the IMU data is not deemed reliable, or the IMU data suggests that the user is not holding their head level, then voice direction discovery may be favored over, or considered in concert with, outputs from the IMU. Upon registering a user command, compute module 325 selects the appropriate function, such as volume adjust, skip/pause song, accept or end phone call, enter enhanced voice mode, enter active noise cancellation mode, enter acoustical beam steering mode, or otherwise (process block 430).

Once the user rotates electronics package 205, the angular position of each microphone 310 in microphone array 305 is changed. This requires rotational compensation or transformation of the HRTF to maintain meaningful state information of the spatial information captured by microphone array 305. Accordingly, in process block 435, compute module 325 applies the appropriate rotational correction (e.g., transformation matrix) to compensate for the new positions of each microphone 310. Again, in one embodiment, input from IMU may be used to apply an instantaneous transformation and acoustical beamforming techniques may be used when output from the IMU is deemed unreliable or to apply a periodic recalibration/validation when the user talks. In the case of using acoustical beamforming to determine the angular position of microphone array 305, the maximum number of detents in the rotary interface is related to the number of microphones 310 in microphone array 305 to enable angular position disambiguation for each of the detents using acoustical beamforming.

In a process block 440, the audio data and/or spatial information captured by microphone array 305 may be used by compute module 325 to apply various audio processing functions (or implement other user functions selected in process block 430). For example, the user may rotate electronics package 205 to designate an angular direction for acoustical beamforming. This angular direction may be selected relative to the user's front to position a null 125 (for selectively muting an unwanted sound) or a maxima lobe 130 (for selectively amplifying a desired sound). Other audio functions may include filtering spectral components to enhance a conversation, adjusting the amount of active noise cancellation, adjusting perceptual transparency, etc.

In a process block 445, one or more of the audio signals captured by microphone array 305 are intelligently combined to generate an audio signal for driving speaker(s) 320 (process block 450). The audio signals output from microphone array 305 may be combined and digitally processed to implement the various processing functions. For example, compute module 325 may analyze the audio signals output from each microphone 310 to identify one or more "lucky microphones." Lucky microphones are those microphones that due to their physical position happen to acquire an audio signal with less noise than the others (e.g., sheltered from wind noise). If a lucky microphone is identified, then the audio signal output from that microphone 310 may be more heavily weighted or otherwise favored for generating the audio signal that drives speaker 320. The data extracted from the other less lucky microphones 310 may still be analyzed and used for other processing functions, such as localization.

In one embodiment, the processing performed by compute module 325 may preserve the user's natural HRTF thereby preserving their normal sense of spaciousness including a sense of the size and nature of the space around them as well as the ability to localize the physical direction from where the original environmental sounds originated. In other words, the user will be able to identify the directional source of sounds originating in their environment despite the fact that the user is hearing a regenerated version of those sounds emitted from speaker 320. The sounds emitted from speaker 320 recreate the spaciousness of the original environmental sounds in a way that the user's mind is able to faithfully localize the sounds in their environment. In one embodiment, reassertion of the natural HRTF is a calibrated feature implemented using machine learning techniques and trained neural networks. In other embodiments, reassertion of the natural HRTF is implemented via traditional signal processing techniques and some algorithmically driven analysis of the listener's original HRTF or outer ear morphology. Regardless, a rotational correction can be applied to the audio signals captured by microphone array 305 by compute module 325 to compensate for rotational variability in microphone array 305.

Figure 5A:
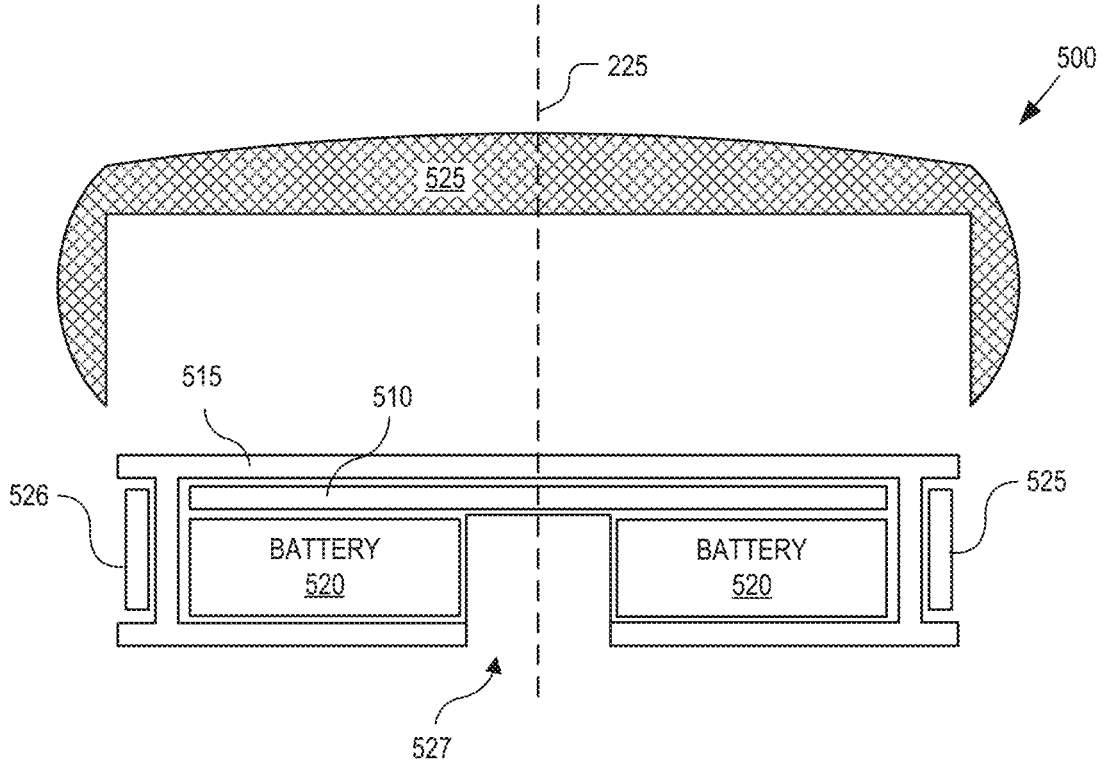
FIGS. 5A & 5B illustrate an electronics package of the ear-mountable listening device including an array of microphones disposed in a ring pattern around a main circuit board, in accordance with an embodiment of the disclosure.
Figure 5B:
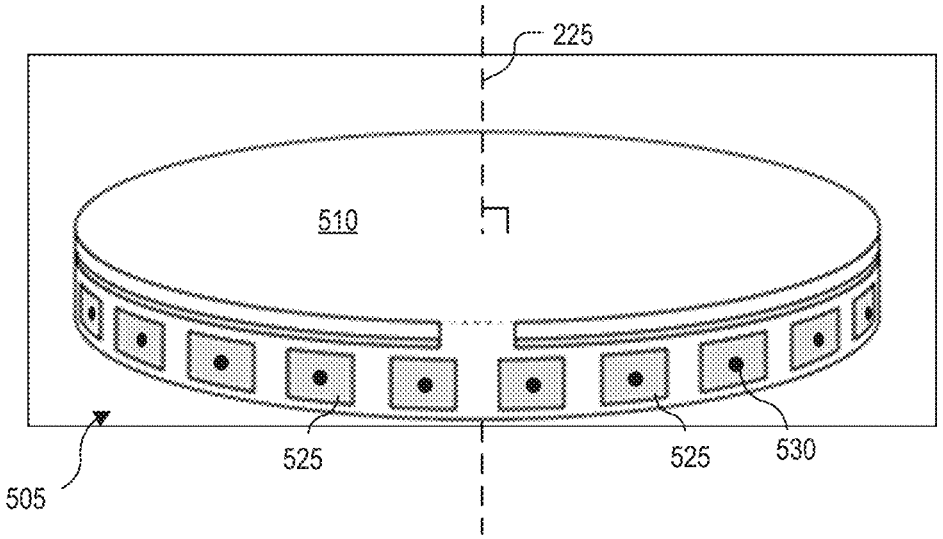

FIGS. 5A & 5B illustrate an electronics package 500, in accordance with an embodiment of the disclosure. Electronics package 500 represents an example internal physical structure implementation of electronics package 205 illustrated in FIG. 2. FIG. 5A is a cross-sectional illustration of electronics package 500 while FIG. 5B is a perspective view illustration of the same excluding cover 525. The illustrated embodiment of electronics package 500 includes an array 505 of microphones, a main circuit board 510, a housing or frame 515, a cover 525, and a rotary port 527. Each microphone within array 505 is disposed on an individual microphone substrate 526 and includes a microphone port 530.

FIGS. 5A & 5B illustrate how array 505 extends around a central axial axis 225. Additionally, in the illustrated embodiment, array 505 extends around a perimeter of main circuit board 510. Although not illustrated, main circuit board 510 includes electronics disposed thereon, such as compute module 325, memory 330, sensors 335, communication circuitry 345, and interface circuitry 350. Main circuit board 510 is illustrated as a solid disc having a circular shape; however, in other embodiments, main circuit board 510 may be an annular disk with a central hole through which post 220 extends to accommodate protrusion of acoustic drivers aligned with the ear canal entrance. In the illustrated embodiment, the surface normal of main circuit board 510 is parallel to and aligned with central axial axis 225 about which the ring pattern of array 505 extends.

The electronics may be disposed on one side, or both sides, of main circuit board 510 to maximize the available real estate. Housing 515 provides a rigid mechanical frame to which the other components are attached. Cover 525 slides over the top of housing 515 to enclose and protect the internal components. In one embodiment, a capacitive touch sensor is disposed on housing 515 beneath cover 525 and coupled to the electronics on main circuit board 510. Cover 525 may be implemented as a mesh material that permits acoustical waves to pass unimpeded and is made of a material that is compatible with capacitive touch sensors (e.g., non-conductive dielectric material).

As illustrated in FIGS. 5A & 5B, array 505 encircles a perimeter of main circuit board 510 with each microphone disposed on an individual microphone substrate 526. In the illustrated embodiment, microphone ports 530 are spaced in substantially equal angular increments about central axial axis 225. Of course, other nonequal spacings may also be implemented. The individual microphone substrate 526 are planer substrates oriented vertical (in the figure) or perpendicular to main circuit board 510 and parallel with central axial axis 225. However, in other embodiments, the individual microphone substrates may be tilted relative to central axial axis 225 and the normal of main circuit board 510. Of course, the microphone array may assume other positions and/or orientations within electronics package 205.

FIG. 5A illustrates an embodiment where main circuit board 510 is a solid disc without a central hole. In that embodiment, post 220 of acoustic package 210 extends into rotary port 527, but does not extend through main circuit board 510. The inside surface of rotary port 527 may include magnets for holding acoustic package 210 therein and conductive contacts for making electrical connections to electrical trace rings 230. Of course, in other embodiments, main circuit board 510 may be an annulus with a center hole 605 allowing post 230 to extend further into electronics package 205 enabling thinner profile designs. A center hole in main circuit board 510 provides additional room or depth for larger acoustic drivers within post 220 of acoustic package 205 to be aligned directly in front of the entrance to the user's ear canal.

Figure 6A:
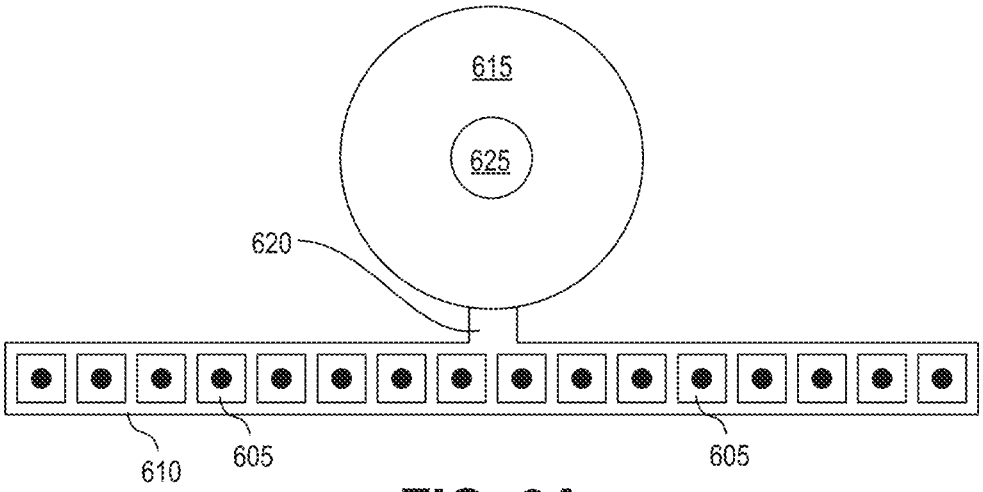
FIGS. 6A and 6B illustrate individual microphone substrates interlinked into the ring pattern via a flexible circumferential ribbon that encircles the main circuit board, in accordance with an embodiment of the disclosure.
Figure 6B:
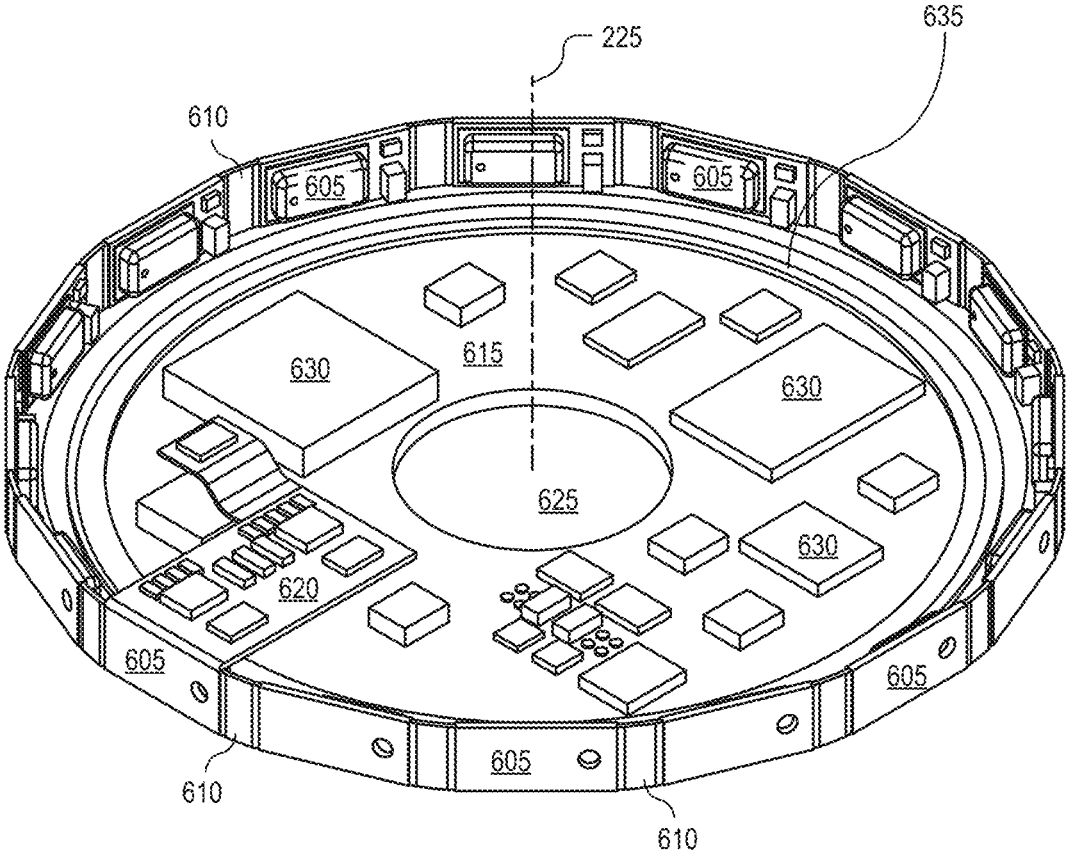

FIGS. 6A and 6B illustrate individual microphone substrates 605 interlinked into a ring pattern via a flexible circumferential ribbon 610 that encircles a main circuit board 615, in accordance with an embodiment of the disclosure. FIGS. 6A and 6B illustrate one possible implementation of some of the internal components of electronics package 205 or 500. As illustrated in FIG. 6A, individual microphone substrates 605 may be mounted onto flexible circumferential ribbon 610 while rolled out flat. A connection tab 620 provides the data and power connections to the electronics on main circuit board 615. After assembling and mounting individual microphone substrates 605 onto ribbon 610, it is flexed into its circumferential position extending around main circuit board 615, as illustrated in FIG. 6B. As an example, main circuit board 615 is illustrated as an annulus with a center hole 625 to accept post 220 (or component protrusions therefrom). Furthermore, the individual electronic chips 630 (only a portion are labeled) and perimeter ring antenna 635 for near field communications between a pair of ear devices 100 are illustrated merely as demonstrative implementations. Of course, other mounting configurations for microphones 605 and microphone substrates 610 may be implemented.

Figure 7:
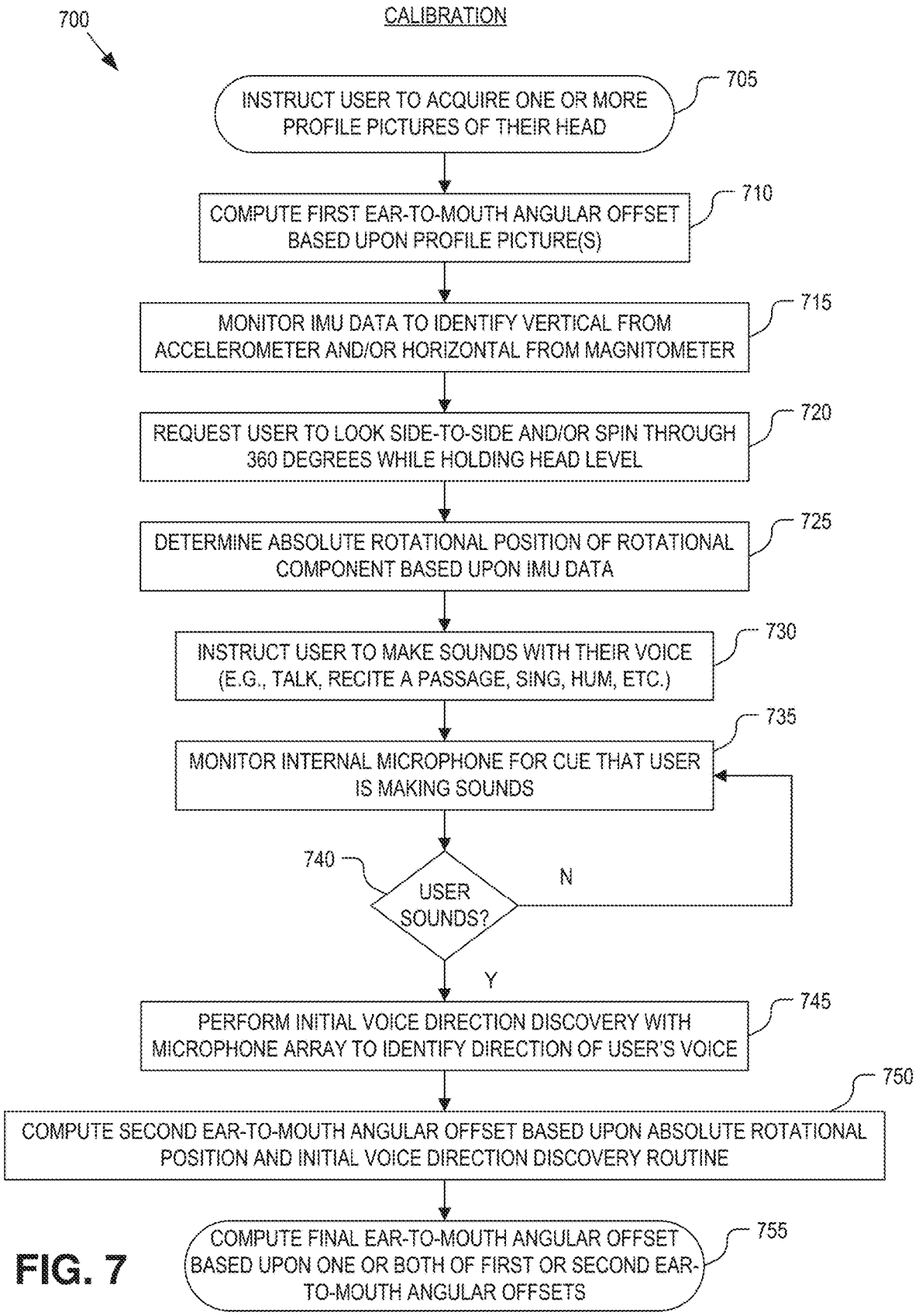
FIG. 7 is a flow chart illustrating a calibration process to determine a user's ear-to-mouth angular offset, in accordance with an embodiment of the disclosure.

FIG. 7 is a flow chart illustrating a calibration process 700 to determine a custom ear-to-mouth angular offset 145 on a per user basis, in accordance with an embodiment of the disclosure. The order in which some or all of the process blocks appear in process 700 should not be deemed limiting. Rather, one of ordinary skill in the art having the benefit of the present disclosure will understand that some of the process blocks may be executed in a variety of orders not illustrated, or even in parallel.

In a process 705, the user is instructed to acquire one or more profile pictures of their head including their ear and mouth. The profile picture may be acquired by another individual or as a selfie with a smartphone from an outstretched arm position. A smartphone application may be implemented to facilitate the calibration processes. In a process 710, a first ear-to-mouth angular offset is computed by analyzing the acquired profile pictures. The graphical computation may be performed on the user's smartphone, or in the cloud. For example, neural networks may be used to identify the centroids of the ear and mouth in the profile pictures and ray trace a line between the centroids from which an ear-to-mouth angular offset may be computed. Other image analysis techniques may be implemented.

Other techniques may be used in addition to (or alternative to) acquiring a profile picture. For example, a reference mark 103 (see FIG. 1F) may be disposed on rotational component 102. The user may be asked to rotate the mark to point towards their mouth and the IMU data extracted (process block 715) to identify ear-to-mouth angular offset 145. Alternatively (or additionally), the IMU data may be monitored in process block 715 to identifying the vertical gravity vector and/or the horizontal magnetic vector while the user is instructed to hold their head level and either look side-to-side or rotate 360 degrees in a circle (process block 720). The side-to-side or circle motion increases the accuracy of determining the vertical/horizontal gravity/magnetic vectors (i.e., Earth's reference frame). The absolute rotational position of rotational component 102 is then determined relative to Earth's reference frame while the user is looking level as previously instructed (process block 725).

In a process block 730, the user is instructed to make sounds with their voice. Sounds may include talking, singing, humming, or otherwise. In one embodiment, the user may be instructed to read a passage displayed on their smartphone. Compute module 325 may monitor internal microphone 355 to determine when the user is speaking (decision block 740). In yet another embodiment, internal microphone 355 may be cross-correlated with the audio captured by microphone array 305 to disambiguate the user's voice from other external noise.

Once it is determined that the user sounds are being received, compute module 325 performs an initial voice direction discovery with microphone array 305 to identify direction of incidence 155 of the user's voice (process block 745). The voice direction discovery routine is described in greater detail in connection with FIG. 8. A second ear-to-mouth angular offset may then be computed by comparing the identified direction of incidence 155 during the initial voice direction discovery against the absolute rotational position determined in process block 725. Finally, in a process block 755, compute module 325 may use one or both of the first and second computed ear-to-mouth angular offsets to determine a finalized ear-to-mouth angular offset 145 used for regular operation.

Figure 8:
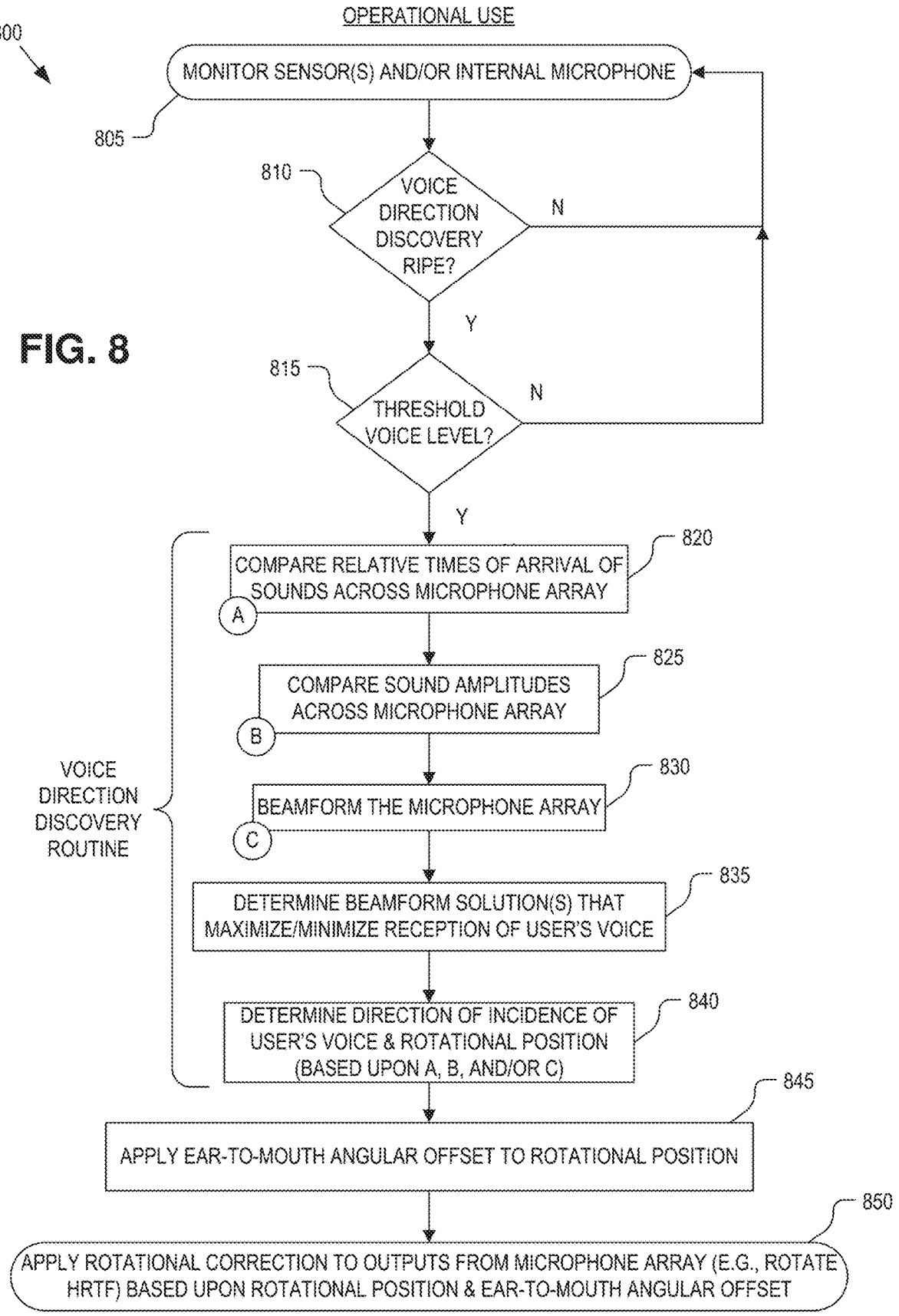
FIG. 8 is a flow chart illustrating a process for applying a rotational correction to audio signals to compensate for physical rotations of the microphone array, in accordance with an embodiment of the disclosure.

FIG. 8 is a flow chart illustrating a process 800 for applying a rotational correction to audio signals captured by microphone array 305 to compensate for physical rotations of microphone array 305 during operational use, in accordance with an embodiment of the disclosure. The order in which some or all of the process blocks appear in process 800 should not be deemed limiting. Rather, one of ordinary skill in the art having the benefit of the present disclosure will understand that some of the process blocks may be executed in a variety of orders not illustrated, or even in parallel.

In a process block 805, compute module 325 monitors internal microphone 355 (or 213) and also optionally monitors sensors 335. Since external noise sources are muted or attenuated for internal microphone 355 due to the design of ear device 100 and the placement of internal microphone 355, monitoring internal microphone 355 helps determine when the user is making vocal noises (e.g., talking, singing, humming, etc.) versus other external noise sources. Distinguishing vocal noises of the user from external noises is important so that voice direction discovery is correctly performed on the user's voice and not erroneously performed on those external noise sources. The IMU within sensors 335 may also be monitored to identify scenarios where the IMU data should not be considered, or at least disfavored, for identifying rotational motion of rotatable component 102. For example, IMU output may be analyzed to identify the rotational position of rotatable component 102 when the user is holding their head level with little or no motion. However, if the IMU data suggests the user is performing vigorous activity or perhaps not holding their head level, then compute module 325 should rely more heavily upon voice direction discovery in lieu of the IMU data. Additionally, IMU data may be used to sense and identify a rapid rotational motion of rotatable component 102, suggesting that the user has rotated microphone array 305 and thus necessitating execution of a voice direction discovery routine to determine the new rotational position of microphone array 305. In scenarios where compute module 325 includes a trained neural network, both the IMU data and internal microphone data may provide relevant data for determining when voice direction discovery is ripe for execution (decision block 810). Determining that the IMU data has fallen within prescribed ranges may also be a factor for determining when to or when not to commence voice direction discovery.

In a decision block 815, the level of internal microphone 355 is monitored for reaching a threshold level or volume. Once the threshold level is reached, voice direction discovery can commence. The voice direction discovery routine may be implemented using a variety of one or more different techniques (e.g., options A, B, and/or C). In a process block 820 (option A), the relative times of arrival of sounds across microphone array 305 are analyzed. The arrival time differentials are indicative of direction of incident 155 of the user's voice 150 as microphones that are further from the user's mouth will receive the audio signal slightly delayed relative to microphones that are closer. In a process block 825 (option B), the sound amplitudes across microphone array 305 are analyzed. Again, the differentials in amplitude across microphone array 305 may also be indicative of direction of incidence 155. In a process block 830 (option C), microphone array 305 is beamformed (adjust position of lobs or nulls) to determine the beamform solution that maximizes or minimizes reception of the user's voice (process block 835). For example, a fixed set of beamforming solutions each pointing in a different direction may be analyzed to see which solution provides the greatest and/or least cross-correlation with the audio being captured by internal microphone 355. In process block 840, one or more of the various voice direction discovery options A, B, C (or otherwise) are analyzed, in isolation or collectively, to determine direction of incidence 155 of the user's voice, which correlates to the rotational position of microphone array 305.

In process block 845, ear-to-mouth angular offset 145 is applied to the rotational position, and then this offset value is used to select a rotational correction to apply to the audio signals captured by microphone array 305 (process block 850). The rotational correction may be a transformation matrix, a correction filter, a selection of a particular set of correction coefficients, a rotational remapping of microphone positions, or otherwise.

The processes explained above are described in terms of computer software and hardware. The techniques described may constitute machine-executable instructions embodied within a tangible or non-transitory machine (e.g., computer) readable storage medium, that when executed by a machine will cause the machine to perform the operations described. Additionally, the processes may be embodied within hardware, such as an application specific integrated circuit ("ASIC") or otherwise.

A tangible machine-readable storage medium includes any mechanism that provides (i.e., stores) information in a non-transitory form accessible by a machine (e.g., a computer, network device, personal digital assistant, manufacturing tool, any device with a set of one or more processors, etc.). For example, a machine-readable storage medium includes recordable/non-recordable media (e.g., read only memory (ROM), random access memory (RAM), magnetic disk storage media, optical storage media, flash memory devices, etc.).

The above description of illustrated embodiments of the invention, including what is described in the Abstract, is not intended to be exhaustive or to limit the invention to the precise forms disclosed. While specific embodiments of, and examples for, the invention are described herein for illustrative purposes, various modifications are possible within the scope of the invention, as those skilled in the relevant art will recognize.

These modifications can be made to the invention in light of the above detailed description. The terms used in the following claims should not be construed to limit the invention to the specific embodiments disclosed in the specification. Rather, the scope of the invention is to be determined entirely by the following claims, which are to be construed in accordance with established doctrines of claim interpretation.

What is claimed is:

1. An ear-mountable listening device, comprising:

an array of microphones configured to capture sounds emanating from an environment and output first audio signals representative of the sounds, wherein the array of microphones has a rotational position that is variable relative to an ear of a user when the ear-mountable listening device is mounted to the ear or is variable while the ear-mountable listening device is worn in the ear;

a speaker arranged to emit audio into the ear in response to a second audio signal; and electronics coupled to the array of microphones and the speaker, the electronics including logic that when executed by the electronics causes the ear-mountable listening device to perform operations including:

discovering a direction of incidence of a voice of the user upon the array of microphones mounted to the ear of the user; and applying a rotational correction to the first audio signals to generate the second audio signal that drives the speaker, wherein the rotational correction is based at least in part upon the direction of incidence of the voice.

2. The ear-mountable listening device of claim 1, wherein the electronics include further logic that when executed by the electronics causes the ear-mountable listening device to perform further operations comprising:

determining a rotational position of the array of microphones relative to a mouth of the user based upon the direction of incidence of the voice; and applying an ear-to-mouth angular offset to the rotational position to determine the rotational correction.

3. The ear-mountable listening device of claim 2, wherein the ear-to-mouth angular offset is a customized value calibrated on a per user basis.

4. The ear-mountable listening device of claim 3, wherein the ear-to-mouth angular offset is based upon at least one of a profile picture of the user or execution of an initial voice direction discover routine.

5. The ear-mountable listening device of claim 1, further comprising:

an internal microphone coupled to the electronics and oriented within the ear-mountable listening device to focus on the voice emanating via an ear canal when the ear-mountable listening device is worn, wherein the electronics include further logic that when executed by the electronics causes the ear-mountable listening device to perform further operations comprising:

monitoring the internal microphone for the voice; and commencing discovering the direction of incidence after the voice exceeds a threshold level as measured by the internal microphone.

6. The ear-mountable listening device of claim 1, wherein the electronics include further logic that when executed by the electronics causes the ear-mountable listening device to perform further operations comprising:

monitoring an inertial monitoring unit (IMU) of the ear-mountable listening device; and commencing discovering the direction of incidence of the voice when a motion or an orientation of the ear-mountable listening device falls within one or more prescribed ranges.

7. The ear-mountable listening device of claim 1, wherein discovering the direction of the voice comprises one or more of:

comparing relative times of arrival of sounds across the array of microphones;

comparing sound amplitudes across the array of microphones; or beamforming the microphone array to identify the direction of incidence.

8. The ear-mountable listening device of claim 1, wherein the array of microphones is disposed within a rotatable component of the ear-mountable listening device, the rotatable component rotatable to provide a user interface for controlling at least one user selectable function of the ear-mountable listening device.

9. The ear-mountable listening device of claim 1, wherein the rotational correction applied to the first audio signals comprises a rotational transformation applied by the electronics to the first audio signals that preserves spaciousness of the sounds emanating from the environment such that the user can localize the sounds based upon the audio output from the speaker despite rotation of the array of microphones.

10. The ear-mountable listening device of claim 1, wherein the electronics include further logic that when executed by the electronics causes the ear-mountable listening device to perform further operations comprising:

reasserting a head related transfer function (HRTF) of the user with the audio output from the speaker despite rotation of the array of microphones.

11. The ear-mountable listening device of claim 1, wherein the electronics include further logic that when executed by the electronics causes the ear-mountable listening device to perform further operations comprising:

determining the rotational correction based at least in part upon a direction indication output from an inertial measurement unit (IMU) of the ear-mountable listening device that changes with rotation of the rotational position of the array of microphones.

12. A method of operation of an ear-mountable listening device, the method comprising:

generating first audio signals representative of sounds emanating from an environment and captured with an array of microphones of the ear-mountable listening device mounted to an ear;

determining a rotational position of the array of microphones, wherein determining the rotational position of the array of microphones comprises:

discovering a direction of incidence of a voice of a user upon the array of microphones while the ear-mountable listening device is worn in the ear of the user; and applying an ear-to-mouth angular offset to the direction of incidence;

applying a rotational correction to the first audio signals to generate a second audio signal, wherein the rotational correction is based at least in part upon the rotational position; and driving a speaker of the ear-mountable listening device with the second audio signal to output audio into the ear.

13. The method of claim 12, further comprising:

sensing a rotational change of the array of microphones; and revising the rotational correction applied to the first audio signals based upon the rotational change.

14. The method of claim 13, further comprising:

adjusting a user function of the ear-mountable listening device in response to the rotational change.

15. The method of claim 14, wherein adjusting the user function in response to the rotational change comprises:

adjusting a volume of the speaker in response to the rotational change of the array of microphones, wherein the array of microphones is disposed within a rotatable component of the ear-mountable listening device.

16. The method of claim 12, wherein the ear-to-mouth angular offset is determined based upon at least one of a profile picture of the user or execution of an initial voice direction discover routine.

17. The method of claim 12, further comprising:

monitoring an internal microphone of the ear-mountable listening device for the voice, wherein the internal microphone is positioned and oriented within the ear-mountable listening device to focus on the voice emanating via an ear canal of the user when the ear-mountable listening device is worn in the ear; and commencing discovering the direction of incidence after the voice exceeds a threshold level as measured by the internal microphone.

18. The method of claim 17, wherein discovering the direction of the voice comprises one or more of:

comparing relative times of arrival of sounds across the array of microphones;

comparing sound amplitudes across the array of microphones; or beamforming the microphone array to identify the direction of incidence.

19. The method of claim 12, wherein the rotational correction applied to the first audio signals comprises a rotational transformation applied by electronics of the ear-mountable listening device to the first audio signals that preserves spaciousness of the sounds emanating from the environment such that the user can localize the sounds based upon the audio output from the speaker despite rotation of the array of microphones.

* * * * *